US011251573B2

(12) United States Patent
Wu et al.

(10) Patent No.: US 11,251,573 B2
(45) Date of Patent: Feb. 15, 2022

(54) PROTECTIVE SHELL ASSEMBLY AND CONNECTOR ASSEMBLY WITH THE PROTECTIVE SHELL ASSEMBLY

(71) Applicant: Dongguan Luxshare Technologies Co., Ltd, Dongguan (CN)

(72) Inventors: Xiao-Ping Wu, Dongguan (CN); You-Rui Zhang, Dongguan (CN); Bai-Yu Duan, Dongguan (CN); Xiao-Kai Wang, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 16/983,799

(22) Filed: Aug. 3, 2020

(65) Prior Publication Data

US 2020/0366035 A1 Nov. 19, 2020

(30) Foreign Application Priority Data

Mar. 4, 2020 (CN) ..... 202010143980.6

(51) Int. Cl.
*H01R 13/717* (2006.01)
*H01R 13/518* (2006.01)

(52) U.S. Cl.
CPC ..... *H01R 13/7172* (2013.01); *H01R 13/518* (2013.01)

(58) Field of Classification Search
CPC ..... H01R 13/502; H01R 13/6594; H01R 13/6587
See application file for complete search history.

(56) References Cited

U.S. PATENT DOCUMENTS 5,876,239 A * 3/1999 Morin ..... H01R 29/00 439/490
7,575,471 B2 8/2009 Long
8,197,282 B1 * 6/2012 Su ..... H01R 13/518 439/541.5
8,335,416 B2 * 12/2012 Shirk ..... G02B 6/4292 385/52
8,870,595 B2 * 10/2014 Schmitt ..... H01R 13/717 439/607.25
9,391,407 B1 * 7/2016 Bucher ..... H01R 13/659
9,787,034 B2 * 10/2017 Yang ..... G02B 6/3817
(Continued)

FOREIGN PATENT DOCUMENTS

CN 1985199 A 6/2007
CN 102239607 A 11/2011
(Continued)

*Primary Examiner* — Jean F Duverne
(74) *Attorney, Agent, or Firm* — Birch, Stewart, Kolasch & Birch, LLP

(57) ABSTRACT

A protective shell assembly is used for accommodating a connector. The protective shell assembly includes a cage and at least one light pipe. The cage has a plurality of wall surfaces, and the wall surfaces are connected to at least one another to define an accommodating space. The at least one light pipe passes through one of the wall surfaces so that a part of the light pipe is located in the accommodating space and the other part is located outside the accommodating space. A connector assembly with the protective shell assembly is also provided.

18 Claims, 8 Drawing Sheets

(56) References Cited

U.S. PATENT DOCUMENTS

| | | | | |
|---|---|---|---|---|
| 2005/0255726 | A1* | 11/2005 | Long | H01R 13/6587 439/80 |
| 2009/0098767 | A1 | 4/2009 | Long | |
| 2018/0115119 | A1* | 4/2018 | Little | H01R 4/2404 |

FOREIGN PATENT DOCUMENTS

| | | | |
|---|---|---|---|
| CN | 104103919 | A | 10/2014 |
| CN | 207819058 | U | 9/2018 |

* cited by examiner

PROTECTIVE SHELL ASSEMBLY AND CONNECTOR ASSEMBLY WITH THE PROTECTIVE SHELL ASSEMBLY

CROSS-REFERENCE TO RELATED APPLICATION

This non-provisional application claims priority under 35 U.S.C. § 119(a) to Patent Application No. 202010143980.6 filed in China, P.R.C. on Mar. 4, 2020, the entire contents of which are hereby incorporated by reference.

BACKGROUND

Technical Field

The invention relates to a protective shell assembly, in particular to a protective shell assembly suitable for a connector.

Related Art

Electrical connectors have been commonly used in current society. A conventional electrical connector includes a body, a light-emitting component, a light pipe and a cage covering the body. The light pipe can assist light focusing and strengthen the indication function in the use of the electrical connector.

However, in the conventional electrical connector, the space in the cage is limited. Therefore, how to effectively use the space to install assemblies, such as the light pipe described above, is a subject of concern for those skilled in the art.

SUMMARY

In view of this, the invention provides a protective shell assembly for accommodating a connector according to an embodiment. The protective shell assembly includes a cage and at least one light pipe.

The cage has a plurality of wall surfaces, and the wall surfaces are connected to at least one another to define an accommodating space. The at least one light pipe passes through one of the wall surfaces so that a part of the light pipe is located in the accommodating space and the other part is located outside the accommodating space.

According to the protective shell assembly described above, in one embodiment, the cage further has a front end and a rear end, and the wall surfaces are located between the front end and the rear end.

According to the protective shell assembly described above, in one embodiment, the wall surfaces include a top wall surface and two opposite side wall surfaces, the side wall surfaces are respectively connected to two opposite sides of the top wall surface, and the light pipe passes through one of the two side wall surfaces.

According to the protective shell assembly described above, in one embodiment, the light pipe has a body portion and an extending portion. The body portion is disposed in the accommodating space and extends toward the front end. One end of the extending portion is connected to the body portion, and the other end passes through one of the two side wall surfaces and is located outside the accommodating space.

According to the protective shell assembly described above, in one embodiment, the extending portion extends in a direction away from the top wall surface.

According to the protective shell assembly described above, in one embodiment, a number of the at least one light pipe is two or more, and each of the light pipes has a body portion and an extending portion. The extending portions pass through the same side wall surface, and a curvature of the extending portion away from the front end of the cage is less than that of the extending portion adjacent to the front end of the cage.

The invention further provides a protective shell assembly for accommodating a connector according to an embodiment. The protective shell assembly includes a cage and at least one light pipe.

The cage has a front end, a rear end and a plurality of wall surfaces. The wall surfaces are located between the front end and the rear end, and the wall surfaces are connected to at least one another to define an accommodating space. The cage further has a perforation provided in one of the wall surfaces. The at least one light pipe has a body portion and an extending portion. The body portion is disposed in the accommodating space and extends toward the front end, one end of the extending portion is connected to the body portion, and the other end passes through the perforation and extends to an outside of the accommodating space.

According to the protective shell assembly described above, in one embodiment, the wall surfaces include a top wall surface and two opposite side wall surfaces, the side wall surfaces are respectively connected to two opposite sides of the top wall surface, and the perforation is located at one of the two side wall surfaces.

According to the protective shell assembly described above, in one embodiment, the extending portion extends in a direction away from the top wall surface.

According to the protective shell assembly described above, in one embodiment, the perforation is an open slot and communicates with a bottom end of the side wall surface.

According to the protective shell assembly described above, in one embodiment, the protective shell assembly further includes a lower cover, engaged with the cage and connected to the bottom ends of the side wall surfaces and closing the open slot.

According to the protective shell assembly described above, in one embodiment, the cage has two perforations, and on the wall surface, a height of the perforation adjacent to the front end of the cage in a longitudinal direction is greater than that of the perforation adjacent to the rear end of the cage.

According to the protective shell assembly described above, in one embodiment, the protective shell assembly further includes at least one limiting frame disposed in the accommodating space. Two sides of the at least one limiting frame are clamped onto the opposite side wall surfaces, and the at least one light pipe is limited in the at least one limiting frame.

According to the protective shell assembly described above, in one embodiment, the protective shell assembly further includes an inner cage, disposed in the accommodating space and shielding the at least one light pipe and the at least one limiting frame. The at least one limiting frame has a clamping structure, and the at least one limiting frame passes through the inner cage to be clamped as the clamping structure onto at least one of the opposite side wall surfaces of the cage.

According to the protective shell assembly described above, in one embodiment, the accommodating space defines an upper receiving space and a lower receiving space, an upper wall surface of the inner cage is located at a bottom side of the upper receiving space, and a lower wall surface of the inner cage is located at a top side of the lower receiving space.

According to the protective shell assembly described above, in one embodiment, a number of the at least one light pipe is two or more, and the light pipes are disposed in the accommodating space in a manner that the body portions are in parallel.

According to the protective shell assembly described above, in one embodiment, each of the light pipes further includes at least one connecting portion extending from the body portion, and the adjacent body portions are connected via the connecting portion.

According to the protective shell assembly described above, in one embodiment, the front end of the cage defines an upper interface and a lower interface, a region where a front end of the body portion is located in the accommodating space defines a light exit region, and the light exit region is located between the upper interface and the lower interface.

According to the protective shell assembly described above, in one embodiment, the extending portions located outside the two side wall surfaces are configured in a staggered manner.

The invention further provides a connector assembly according to an embodiment, including the protective shell assembly according to any of the above and at least one connector. The at least one connector is disposed in the cage and located at a rear side of the accommodating space, and is not in contact with the at least one light pipe.

According to the connector assembly described above, in one embodiment, the connector includes two receiving slots respectively corresponding to the upper interface and the lower interface.

Through the protective shell assembly according to one or more embodiments of the invention, a part of the light pipe extends out of the wall surface of the cage, thereby effectively utilizing the accommodating space in the cage without affecting functions of the light pipe, and solving the problems encountered in the prior art. The connector assembly according to an embodiment of the invention has the protective shell assembly described above, and thus, has the same effect.

DETAILED DESCRIPTION

Figure 1A:
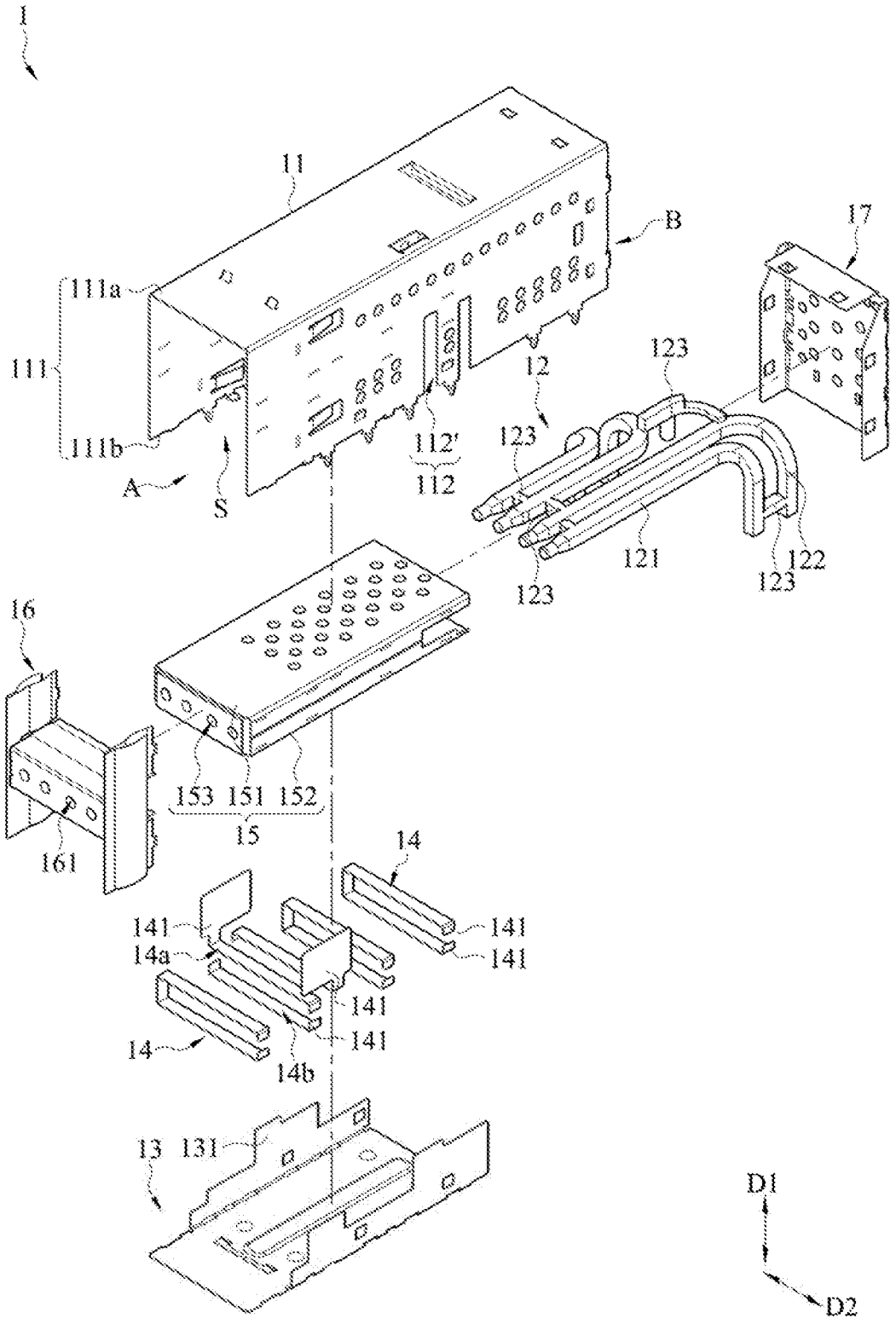
FIG. 1A is a schematic exploded view of an embodiment of a protective shell assembly of the invention.
Figure 1B:
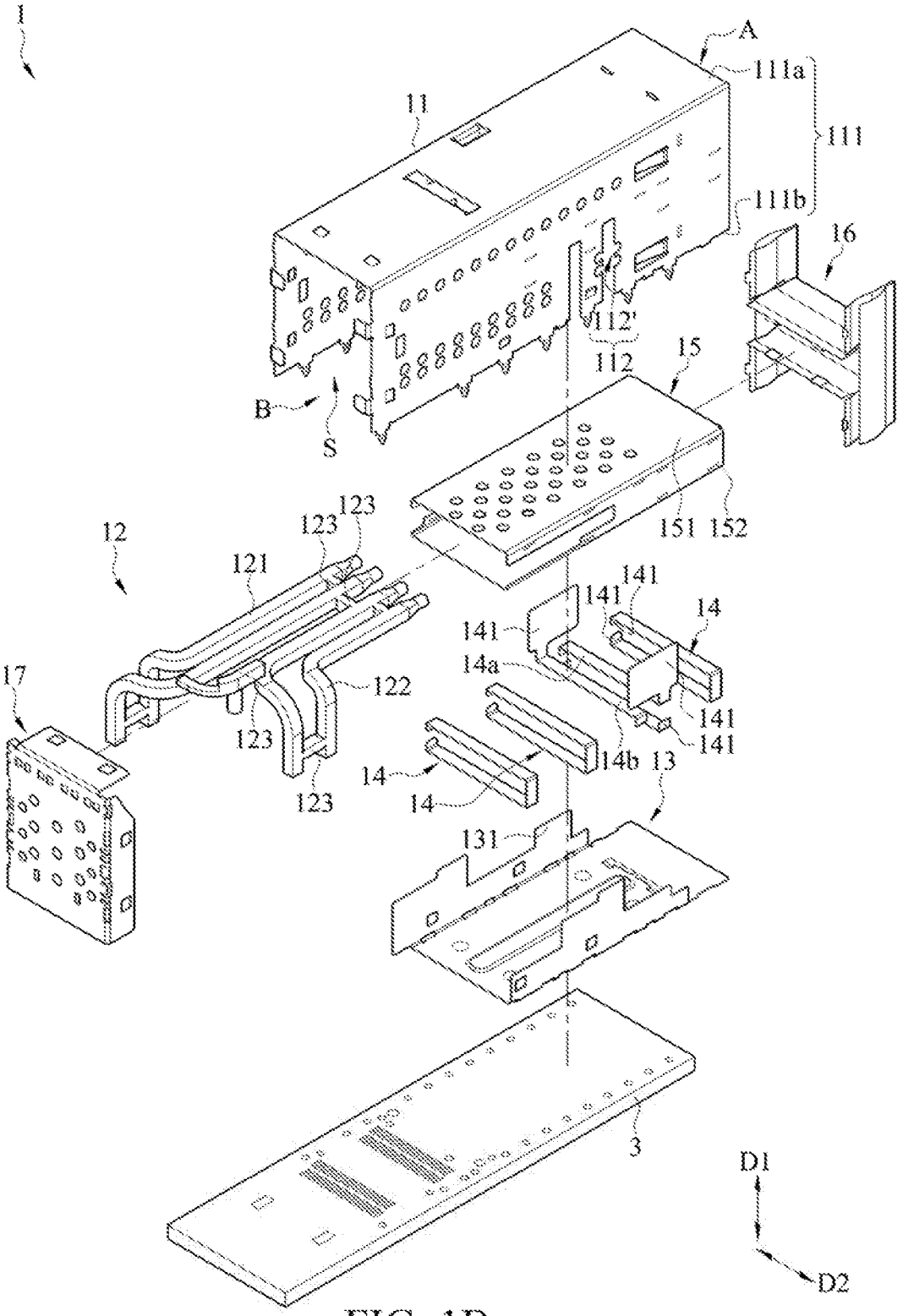
FIG. 1B is a schematic exploded view of the embodiment shown in FIG. 1A from another viewing angle.
Figure 2:
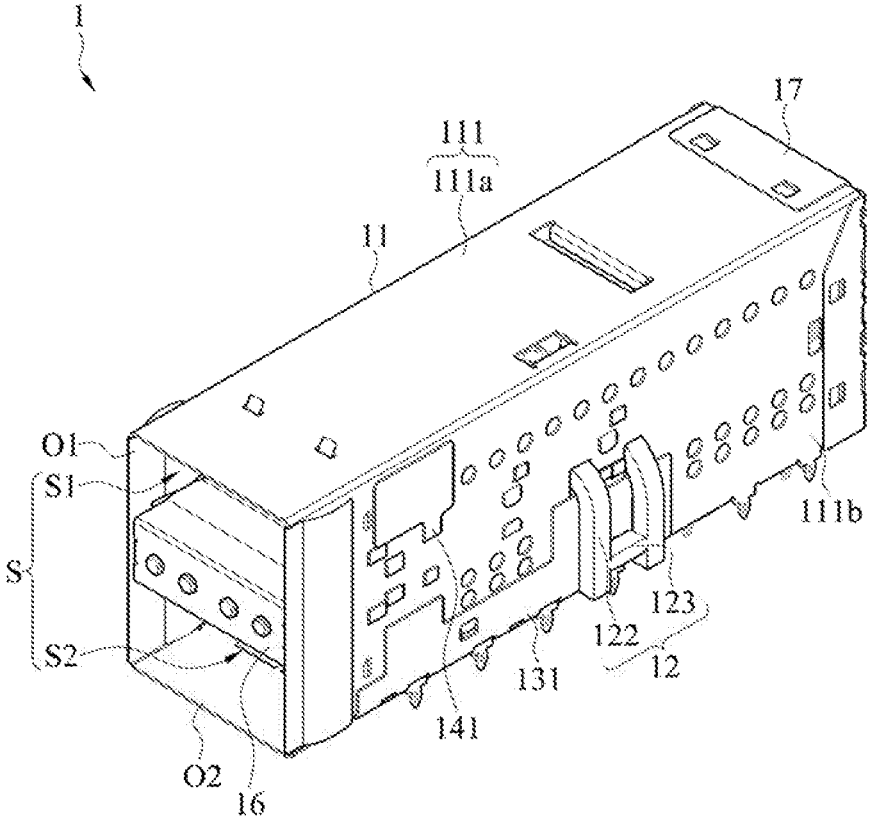
FIG. 2 is an assembled view of the embodiment shown in FIG. 1A.

Referring to FIG. 1A to FIG. 2, FIG. 1A is a schematic exploded view of an embodiment of a protective shell assembly of the invention. FIG. 1B is a schematic exploded view of the embodiment shown in FIG. 1A from another viewing angle. FIG. 2 is an assembled view of the embodiment shown in FIG. 1A. A protective shell assembly 1 may be used for accommodating a connector, and a type of the connector is QSFP (Quad Small Form-factor Pluggable), SFP (Small Form-factor Pluggable), OSFP (Octal Small Form-factor Pluggable), SFP-DD (Double Density) or the like.

As shown in FIG. 1A to FIG. 2, the protective shell assembly 1 includes a cage 11 and at least one light pipe 12. In the present embodiment, the number of the light pipes 12 is plural. The cage 11 has a plurality of wall surfaces 111, and the wall surfaces 111 are connected to at least one another to define an accommodating space S. The light pipe 12 passes through one of the wall surfaces 111 so that a part of the light pipe 12 is located in the accommodating space S and the other part is located outside the accommodating space S.

As shown in FIG. 1A to FIG. 2, in the present embodiment, the cage 11 further has a front end A and a rear end B, and the wall surfaces 111 are located between the front end A and the rear end B. In the present embodiment, the wall surface 111 includes a top wall surface 111*a* and two opposite side wall surfaces 111*b*, the side wall surfaces 111*b* are respectively connected to two opposite sides of the top wall surface 111*a*, and the light pipes 12 adjacent to the two side wall surfaces 111*b* respectively passes through the two side wall surfaces 111*b*. However, the invention is not limited thereto. In some embodiments, the light pipes 12 may pass through the top wall surface 111*a* (not shown in the figure). In the embodiment shown in FIG. 1A, the protective shell assembly 1 further includes a front cover 16 and a rear cover 17. The front cover 16 is located at the front end A of the cage 11, is generally in an H shape, and is engaged with the top wall surface 111*a* and the two side wall surfaces 111*b*. The back cover 17 is located at the rear end B of the cage 11, and is engaged with the top wall surface 111*a* and the two side wall surfaces 111*b*.

Figure 3A:
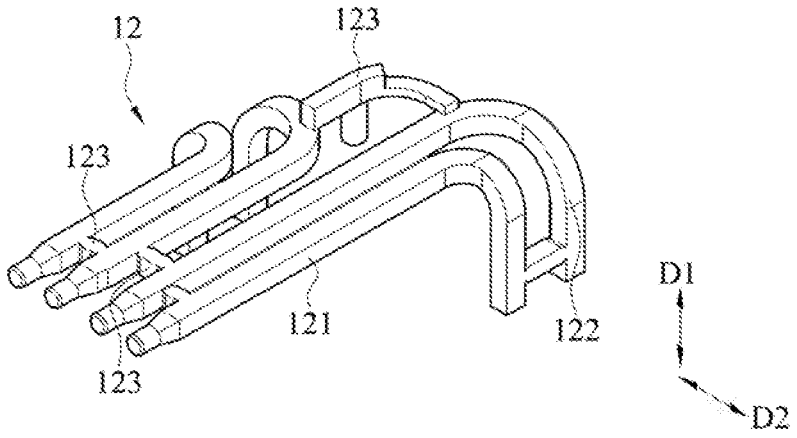
FIG. 3A is a schematic view of appearance of a light pipe of the embodiment shown in FIG. 1A.
Figure 3B:
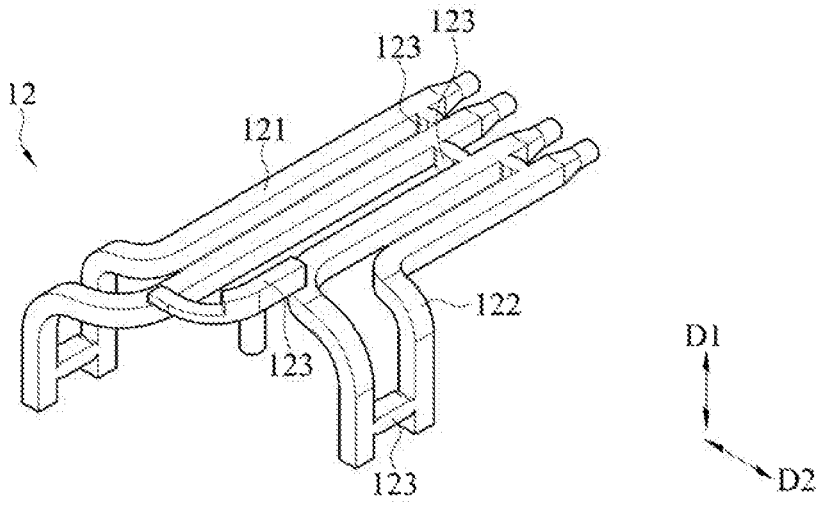
FIG. 3B is a schematic view of the appearance of the embodiment shown in FIG. 3A from another viewing angle.

Please refer to FIG. 3A and FIG. 3B, which are respectively schematic views of appearance of the light pipe of the embodiment shown in FIG. 1A. A difference between FIG. 3A and FIG. 3B lies in different viewing angles. The light pipe 12 has a body portion 121 and an extending portion 122. The body portion 121 is disposed in the accommodating space S and extends toward the front end A. One end of each of the extending portions 122 is connected to the body portion 121, and the other end respectively passes through the two side wall surfaces 111*b* and is located outside the accommodating space S. In addition, in the present embodiment, the extending portion 122 located outside the accommodating space S extends in a direction away from the top wall surface 111*a*. The plurality of light pipes 12 are disposed in the accommodating space S in a manner that the body portions 121 are in parallel, each of the light pipes 12 further includes a connecting portion 123, the connecting portion 123 extends from the body portion 121, and the adjacent light pipes 12 are connected via the connecting portion 123.

As shown in FIG. 3A and FIG. 3B, the extending portions 122 of the light pipes 12 located outside the two side wall surfaces 111*b* are configured in a staggered manner. One said extending portion 122 outside one of the two side wall surfaces 111*b* is adjacent to the front end, and the other extending portion 122 outside another one of the two side wall surfaces 111*b* is away from the front end. Thus, when a plurality of the protective shell assemblies 1 are disposed in a lateral direction D2, for example, the plurality of protective shell assemblies 1 are in parallel to each other, on the adjacent side wall surfaces 111*b* of different protective shell assemblies 1, the extending portions 122 of the light pipes 12 do not interfere with each other, so that the space may be effectively utilized.

In addition, in the embodiment shown in FIG. 3A and FIG. 3B, the number of the light pipes 12 is plural. The number of the extending portions 122 passing through the same side wall surface 111*b* is two. A curvature of the extending portion 122 away from the front end A of the cage 11 (referring to FIG. 1A to FIG. 2) is less than that of the extending portion 122 adjacent to the front end A of the cage 11. Since the light pipe 12 of which the extending portion 122 is away from the front end A of the cage 11 is longer, the curvature of the extending portion 122 is designed to be less than that of the extending portion 122 adjacent to the front end A of the cage 11, so that more light may be totally reflected and a phenomenon of light leakage may be avoided.

Referring to FIG. 1A to FIG. 2 again, in the present embodiment, the cage 11 has a perforation 112 provided in the side wall surface 111*b* so that one end of the extending portion 122 of the light pipe 12 passes through the perforation and extends to an outside of the accommodating space S. In addition, the perforation 112 is an open slot 112' and communicates with a bottom end of the side wall surface 111*b*. An opening of the open slot 112' at the bottom end of the side wall surface 111*b* is used for allowing the extending portion 122 to pass through so as to form a pattern that the extending portion 122 passes through the perforation 112. However, the invention is not limited thereto. In some embodiments, the perforation 112 does not communicate with the bottom end of the side wall surface 111*b*. The protective shell assembly 1 further includes a lower cover 13 capable of being engaged with the cage 11 and connected to the bottom end of the side wall surface 111*b*. The lower cover 13 includes a covering portion 131 corresponding to the open slot 112' and closing the opening of the open slot 112' at the bottom end of the side wall surface 111*b*, so that the extending portion 122 is not detached in a direction parallel to the side wall surface 111*b*, as shown in FIG. 2.

In the present embodiment, the side wall surface 111*b* is provided with two perforations 112. A height of the perforation 112 adjacent to the front end A of the cage 11 in a longitudinal direction D1 is greater than that of the perforation 112 adjacent to the rear end B of the cage 11, as shown in FIG. 1A to FIG. 1B. As mentioned above, since the light pipe 12 of which the extending portion 122 is away from the front end A of the cage 11 is longer, the perforations 112 of different heights are provided corresponding to the curvature of the extending portion 122, so that more light may be totally reflected and the phenomenon of light leakage may be avoided.

Figure 4:
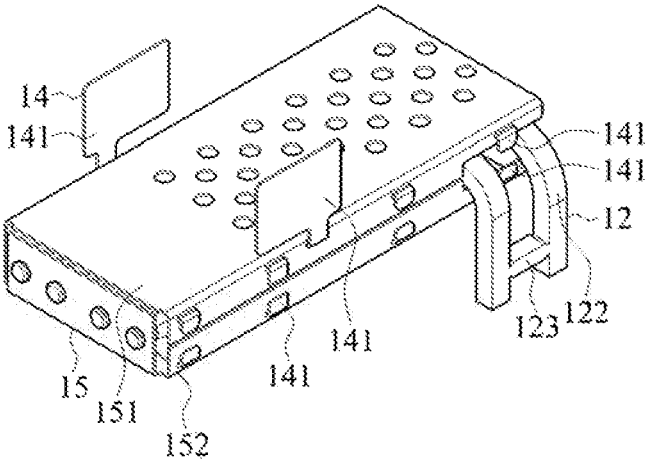
FIG. 4 is an assembled view of an inner cage, a limiting frame and a light pipe of the embodiment shown in FIG. 1A.

Referring to FIG. 1A to FIG. 2 again together with FIG. 4, FIG. 4 is an assembled view of an inner cage 15, a limiting frame 14 and the light pipe 12 of the embodiment shown in FIG. 1A. The protective shell assembly 1 further includes the limiting frame 14. There may be one or a plurality of limiting frames 14 disposed in the accommodating space S. The limiting frame 14 has a clamping structure 141 capable of being clamped onto the side wall surface 111*b*. The limiting frame 14 has multiple forms, for example, it is generally in a C shape, and has a clamping structure 141 on two sides, which is clamped onto the side wall surface 111*b*. Or it is divided into an upper frame 14*a* and a lower frame 14*b*, each of which has a clamping structure 141 respectively clamped onto the side wall surface 111*b*. The limiting frame 14 is framed outside the light pipe 12 to limit the light pipe 12 therein. In the present embodiment, there are a plurality of the limiting frames 14, including the above-mentioned forms. However, the invention is not limited thereto. In some embodiments, the limiting frame 14 is an integrated structure and is provided with the clamping structures 141 respectively clamped onto the two side wall surfaces 111*b*.

In the present embodiment, the protective shell assembly 1 further includes the inner cage 15, disposed in the accommodating space S and shielding the light pipe 12 and the limiting frame 14. The limiting frame 14 passes through the inner cage 15 and is clamped as the clamping structure 141 onto the side wall surface 111*b* so as to fix the inner cage 15 to the cage 11 (as shown in FIG. 4). In order to enhance the protection to the light pipe 12 from contact and abrasion of foreign objects, the inner cage 15 may protect the light pipe 12. In addition, a front end A of the inner cage 15 is provided with a through hole 153 respectively corresponding to the front end A of each light pipe 12 so that the front end A of each light pipe 12 protrudes from the through hole 153. The front cover 16 is also provided with a hole 161 corresponding to the front end A of each light pipe 12, so that the front end A of each light pipe 12 protrudes from the hole 161, and thus, the light pipe 12 may focus light on the front end A to indicate a user.

Based on the above, referring to FIG. 2 again, the protective shell assembly 1 is suitable for a connector. In the present embodiment, the accommodating space S defines an upper receiving space S1 and a lower receiving space S2 therein, an upper wall surface 151 of the inner cage 15 is located at a bottom side of the upper receiving space S1, and a lower wall surface 152 of the inner cage 15 is located at a top side of the lower receiving space S2. That is, the inner cage 15 divides the inside of the accommodating space S into two spaces, namely the upper receiving space S1 and the lower receiving space S2. Corresponding to the upper receiving space S1 and the lower receiving space S2, the front end A of the cage 11 defines an upper interface O1 and a lower interface O2, the front end A of the body portion 121 of the light pipe 12 defines a light exit region, and the light exit region is located between the upper interface O1 and the lower interface O2. That is, when the user plugs a plug-in connector into the upper interface O1, the plug-in connector directly contacts the upper wall surface 151 of the inner cage 15, and when the user plugs the plug-in connector into the lower interface O2, the plug-in connector directly contacts the lower wall surface 152 of the inner cage 15. In some embodiments, the interface is a receptacle.

Figure 5A:
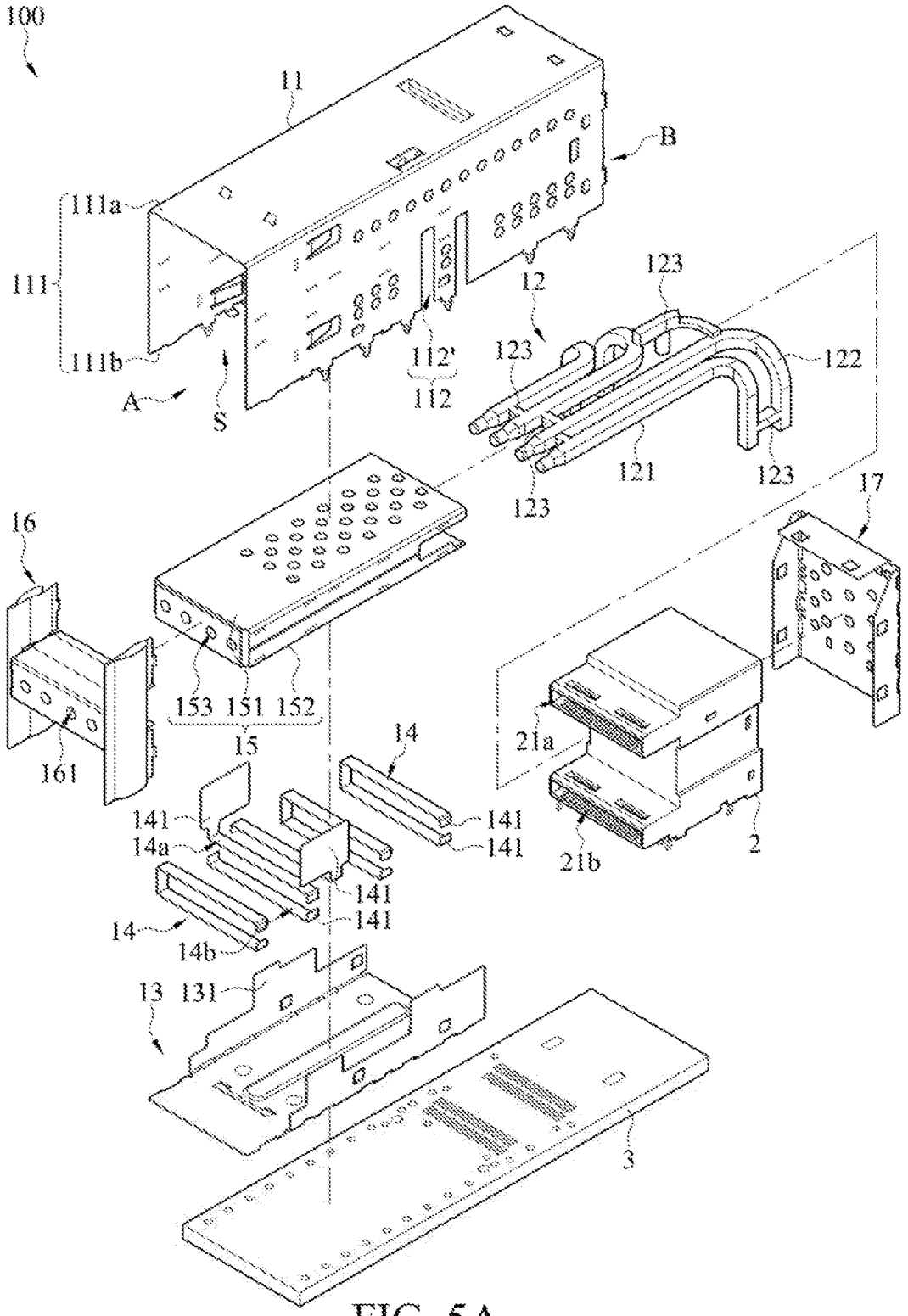
FIG. 5A is a schematic exploded view of an embodiment of a connector assembly of the invention.
Figure 5B:
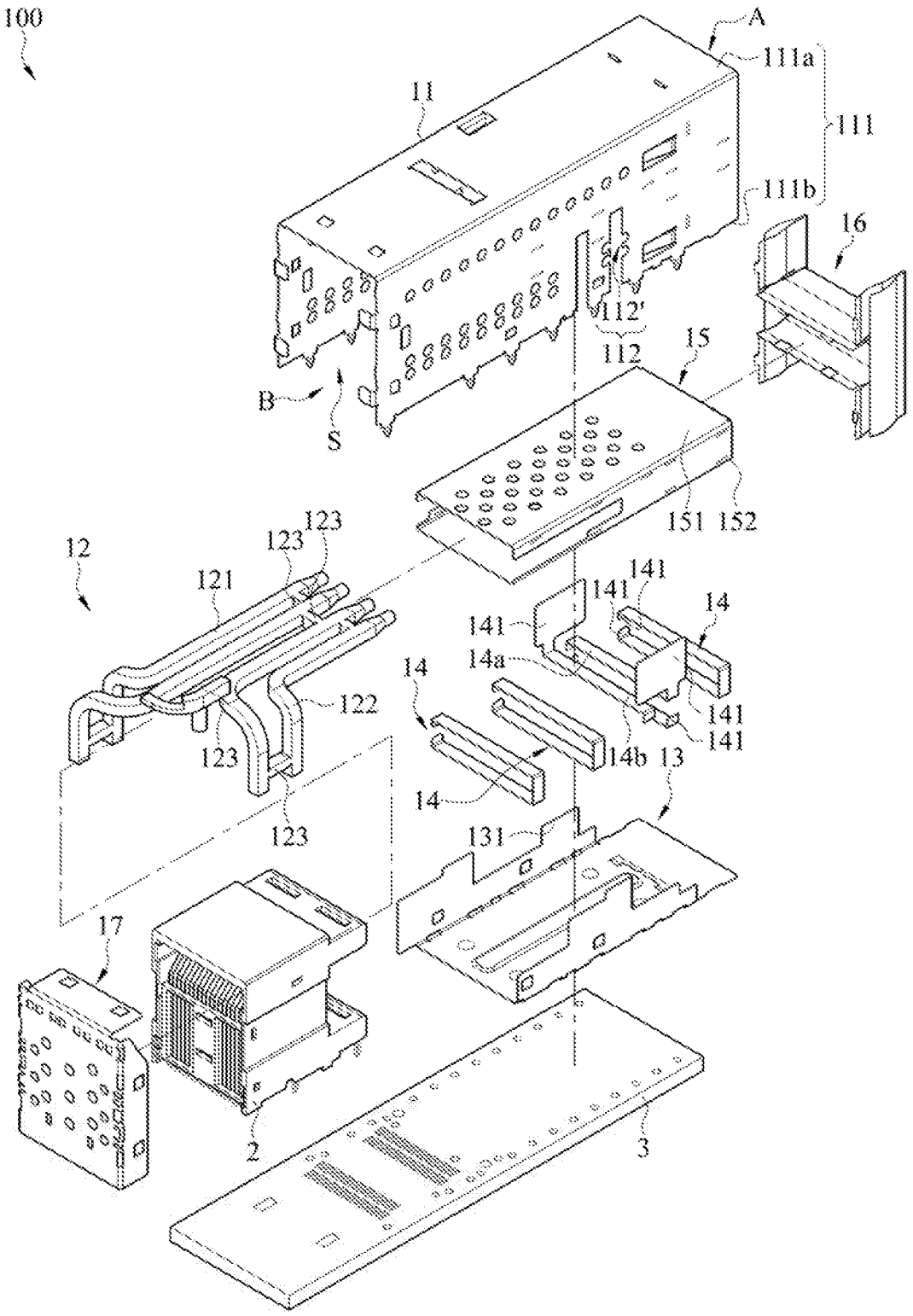
FIG. 5B is a schematic exploded view of the embodiment shown in FIG. 5A from another viewing angle.
Figure 6:
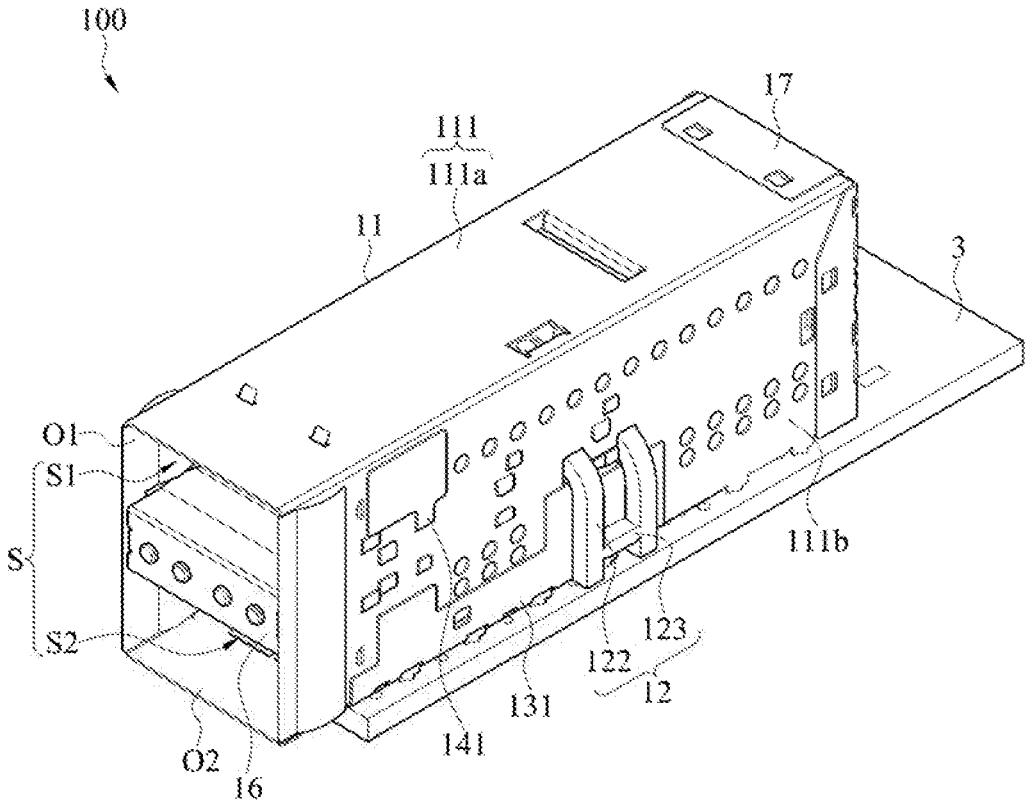
FIG. 6 is an assembled view of the embodiment shown in FIG. 5A.

Referring to FIG. 5A to FIG. 6, FIG. 5A is a schematic exploded view of an embodiment of a connector assembly 100 of the invention. FIG. 5B is a schematic exploded view of the embodiment shown in FIG. 5A from another viewing angle. FIG. 6 is an assembled view of the embodiment shown in FIG. 5A. A connector assembly 100 includes the above-mentioned protective shell assembly 1, a connector 2 and a circuit board 3. For the protective shell assembly 1, please refer to FIG. 1A to FIG. 4 and related descriptions in the above paragraphs again, and details are not repeated here.

The extending portion 122 of the light pipe 12 and the connector 2 are electrically connected to the circuit board 3. The connector 2 is disposed in the cage 11 of the protective shell assembly 1 and located at a rear side of the accommodating space S, and is not in contact the light pipe 12. Based on the above, the inner cage 15 (having the light pipe 12 therein) divides the accommodating space S into the upper receiving space S1 and the lower receiving space S2, in the present embodiment, the connector 2 includes two receiving slots 21*a*, 21*b*, of which positions are respectively corresponding to those of the upper interface O1 and the lower interface O2. In some embodiments, there may be two connectors 2 respectively disposed in the upper receiving space S1 and the lower receiving space S2.

According to the protective shell assembly of one or more embodiments of the invention, a part of the light pipe extends out of the wall surface of the cage, so that the accommodating space is effectively utilized without affecting functions of the light pipe. The plurality of light pipes are installed. In order to enhance the protection to the light pipes, the limiting frame and the inner cage can also be disposed in the cage (the accommodating space). In summary, the problems encountered in the prior art can be solved. The connector assembly according to an embodiment of the invention has the protective shell assembly described above, and thus, has the same effect.

What is claimed is:

1. A protective shell assembly for accommodating a connector, the protective shell assembly comprising:

a cage, having a plurality of wall surfaces, wherein the wall surfaces are connected to at least one another to define an accommodating space; and at least one light pipe, passing through one of the wall surfaces so that a part of the light pipe is located in the accommodating space and the other part is located outside the accommodating space, wherein the cage further has a front end and a rear end, and the wall surfaces are located between the front end and the rear end, and wherein the wall surfaces comprise a top wall surface and two opposite side wall surfaces, the side wall surfaces are respectively connected to two opposite sides of the top wall surface, and the light pipe passes through one of the two side wall surfaces.

2. The protective shell assembly according to claim 1, wherein the light pipe has a body portion and an extending portion; the body portion is disposed in the accommodating space and extends toward the front end; one end of the extending portion is connected to the body portion, and the other end passes through one of the two side wall surfaces and is located outside the accommodating space.

3. The protective shell assembly according to claim 2, wherein the extending portion extends in a direction away from the top wall surface.

4. The protective shell assembly according to claim 1, wherein a number of the at least one light pipe is two or more, and each of the light pipes has a body portion and an extending portion; the extending portions pass through the same side wall surface, and a curvature of the extending portion away from the front end of the cage is less than that of the extending portion adjacent to the front end of the cage.

5. The protective shell assembly according to claim 1, further comprising at least one limiting frame disposed in the accommodating space, wherein two sides of the at least one limiting frame are clamped onto the opposite side wall surfaces, and the at least one light pipe is limited in the at least one limiting frame.

6. The protective shell assembly according to claim 5, further comprising an inner cage, disposed in the accommodating space and shielding the at least one light pipe and the at least one limiting frame, wherein the at least one limiting frame has a clamping structure, and the at least one limiting frame passes through the inner cage to be clamped as the clamping structure onto at least one of the opposite side wall surfaces of the cage.

7. The protective shell assembly according to claim 6, wherein the accommodating space defines an upper receiving space and a lower receiving space, an upper wall surface of the inner cage is located at a bottom side of the upper receiving space, and a lower wall surface of the inner cage is located at a top side of the lower receiving space.

8. The protective shell assembly according to claim 2, wherein a number of the at least one light pipe is two or more, and the light pipes are disposed in the accommodating space in a manner that the body portions are in parallel.

9. The protective shell assembly according to claim 8, wherein each of the light pipes further includes at least one connecting portion extending from the body portion, and the adjacent body portions are connected via the connecting portion.

10. The protective shell assembly according to claim 1, wherein the front end of the cage defines an upper interface and a lower interface, a region where a front end of the body portion is located in the accommodating space defines a light exit region, and the light exit region is located between the upper interface and the lower interface.

11. The protective shell assembly according to claim 2, wherein the extending portions located outside the two side wall surfaces are configured in a staggered manner.

12. A connector assembly, comprising:

the protective shell assembly according to any of claim 1; and at least one connector, disposed in the cage and located at a rear side of the accommodating space, and not in contact with the at least one light pipe.

13. The connector assembly according to claim 12, wherein the at least one connector comprises two receiving slots respectively corresponding to the upper interface and the lower interface.

14. A protective shell assembly for accommodating a connector, the protective shell assembly comprising:

a cage, having a front end, a rear end and a plurality of wall surfaces, wherein the wall surfaces are located between the front end and the rear end, and the wall surfaces are connected to at least one another to define an accommodating space; the cage further has a perforation provided in one of the wall surfaces; and at least one light pipe, having a body portion and an extending portion, wherein the body portion is disposed in the accommodating space and extends toward the front end, one end of the extending portion is connected to the body portion, and the other end passes through the perforation and extends to an outside of the accommodating space, wherein the wall surfaces comprise a top wall surface and two opposite side wall surfaces, the side wall surfaces are respectively connected to two opposite sides of the top wall surface, and the perforation is located at one of the two side wall surfaces.

15. The protective shell assembly according to claim 14, wherein the extending portion extends in a direction away from the top wall surface.

16. The protective shell assembly according to claim 14, wherein the perforation is an open slot and communicates with a bottom end of the side wall surface.

17. The protective shell assembly according to claim 16, further comprising a lower cover, engaged with the cage and connected to the bottom ends of the side wall surfaces and closing the open slot.

18. The protective shell assembly according to claim 14, wherein the cage has two perforations, and on the wall surface, a height of the perforation adjacent to the front end of the cage in a longitudinal direction is greater than that of the perforation adjacent to the rear end of the cage, and the number of light pipe is two, and the two light pipes pass through the two perforations respectively.

* * * * *